US007407561B2

(12) United States Patent
Song et al.

(10) Patent No.: US 7,407,561 B2
(45) Date of Patent: Aug. 5, 2008

(54) USE OF WATER-SOLUBLE CROSSLINKED CATIONIC POLYMERS FOR CONTROLLING DEPOSITION OF PITCH AND STICKIES IN PAPERMAKING

(75) Inventors: Zhiqiang Song, Newton, CT (US); Philip Anson Ford, Suffolk, VA (US)

(73) Assignee: Ciba Specialty Chemicals Water Treatments Ltd., West Yorkshire, Bradford (GB)

( * ) Notice: Subject to any disclaimer, the term of this patent is extended or adjusted under 35 U.S.C. 154(b) by 343 days.

(21) Appl. No.: 10/827,790

(22) Filed: Apr. 20, 2004

(65) Prior Publication Data

US 2004/0226676 A1 Nov. 18, 2004

Related U.S. Application Data

(60) Provisional application No. 60/470,073, filed on May 13, 2003.

(51) Int. Cl.
*D21H 21/02* (2006.01)
*D21H 17/33* (2006.01)
*C08F 136/18* (2006.01)

(52) U.S. Cl. ..... 162/168.2; 162/147; 162/191; 162/185; 526/295; 526/336; 525/331.9; 525/344

(58) Field of Classification Search ..... 162/DIG. 4, 162/168.2, 147, 191, 185; 526/295, 336; 525/331.9, 344
See application file for complete search history.

(56) References Cited

U.S. PATENT DOCUMENTS

| | | | | |
|---|---|---|---|---|
| 3,544,318 | A | 12/1970 | Boothe et al. | 96/1.5 |
| 3,968,037 | A | 7/1976 | Morgan et al. | 210/47 |
| 4,100,079 | A | 7/1978 | Sinkovitz et al. | 252/8.55 |
| 4,225,445 | A | 9/1980 | Dixon | 252/8.55 |
| 4,439,580 | A | 3/1984 | Schaper | 524/801 |
| 5,131,982 | A | 7/1992 | St. John | 162/168.2 |
| 5,248,744 | A | 9/1993 | Cramm et al. | 526/73 |
| 5,256,252 | A | 10/1993 | Sarkar et al. | 162/72 |
| 5,376,237 | A * | 12/1994 | Ishiguro et al. | 162/134 |
| 5,422,408 | A | 6/1995 | Cramm et al. | 526/219.2 |
| 5,653,886 | A | 8/1997 | Kerr et al. | 210/727 |
| 5,837,100 | A | 11/1998 | Gerli et al. | 162/168.2 |
| 5,989,382 | A | 11/1999 | Parker | 156/292 |
| 5,989,392 | A * | 11/1999 | Tang et al. | 162/191 |
| 6,051,160 | A | 4/2000 | Hlivka et al. | 252/180 |
| 6,323,306 | B1 * | 11/2001 | Song et al. | 528/342 |
| 6,423,801 | B1 * | 7/2002 | Hahn et al. | 526/258 |
| 2004/0034156 | A1 * | 2/2004 | Song | 524/556 |

FOREIGN PATENT DOCUMENTS

| | | |
|---|---|---|
| EP | 0058622 | 8/1982 |
| EP | 0264710 | 4/1988 |
| EP | 0464993 | 1/1992 |
| EP | 0600592 | 6/1994 |
| WO | 99/19262 | 4/1999 |
| WO | 00/34581 | 6/2000 |
| WO | 01/88264 | 11/2001 |

OTHER PUBLICATIONS

English language Abstract for EP 0264710 (1988).
Ghimici et al., Journal of Polymer Science: Part B, Polymer Physics, vol. 35, pp. 2571-2581, (1997).
L. Gu et al., Journal of Applied Polymer Science, vol. 74, pp. 1412-1416, (1999).
Ma et al., Colloid Polym. Sci., vol. 277, pp. 115-122 (1999).

* cited by examiner

*Primary Examiner*—Steven P. Griffin
*Assistant Examiner*—Dennis R. Cordray
(74) *Attorney, Agent, or Firm*—Shiela A. Loggins

(57) ABSTRACT

The present invention relates to a method for controlling pitch and stickies deposit in a pulp and papermaking process using crosslinked cationic polymers made by controlled addition of a water soluble radical initiator at reaction temperature with agitation for chain extension and crosslinking.

23 Claims, No Drawings

USE OF WATER-SOLUBLE CROSSLINKED CATIONIC POLYMERS FOR CONTROLLING DEPOSITION OF PITCH AND STICKIES IN PAPERMAKING

This application claims the benefit of U.S. Provisional Application No. 60/470,073, filed May 13, 2003.

The present invention relates to a method for controlling pitch and stickies deposit in a pulp and papermaking process using crosslinked cationic polymers made by controlled addition of a water soluble radical initiator at reaction temperature with agitation for chain extension and crosslinking.

BACKGROUND OF THE INVENTION

The present invention is directed to the use of a high molecular weight (MW), crosslinked, water-soluble cationic polymer for controlling and preventing deposition of pitch and stickies in papermaking.

Cationic polymers have been used extensively in paper making as flocculants for improving retention and drainage and as coagulants or fixatives to control anionic trash and deposition of pitch and stickies. Among the most important and extensively used cationic polymers for deposit control are the quaternary ammonium polymers of diallyldialkyl ammonium compounds. It has been shown that the higher the molecular weight (MW) of the resulting cationic polymer, the more effective the polymer is as a flocculating agent. Normally a linear polymer of diallydimethyl ammonium choloride (DADMAC) is prepared. Polymerization using an azo initiator and/or with added inorganic salts (U.S. Pat. No. 5,248,744, U.S. Pat. No. 5,422,408, U.S. Pat. No. 4,439,580) has been used to achieve high MW. Use of crosslinking or branching agents in polymerization is another way to produce high MW cationic polymers. Polymerization with crosslinking agents can give high MW as well as structured polymers. A highly branched polyDADMAC can have better efficacy than a linear one of similar MW in certain types of applications.

U.S. Pat. No. 3,544,318 teaches that branched polyDADMAC is more effective than a linear polyDADMAC for electroconductive paper because the branched polymer imparts superior barrier properties to the electroconductive paper substrate, preventing solvent from diffusing into the paper.

Copending U.S. application Ser. No. 10/639,105 discloses crosslinked polyDADMAC by a Post-polymerization crosslinking reaction using water soluble radical initiators.

U.S. Pat. No. 3,968,037 shows that cationic polymers obtained by inverse (water-in-oil) emulsion polymerization with crosslinking and branching agents have surprisingly high effectiveness as flocculants and for the treatment of activated sewage sludge. The inventors used polyolefinic unsaturated compounds, such as tri and tetra-allyl ammonium salts, methylenebisacrylamide, as the crosslinking agents. They found that only ineffective products were obtained from solution polymerization containing a crosslinking agent.

European Pat. No. 0264710B1 claims that highly branched water-soluble polyDADMAC made from solution polymerization works better as a flocculant or defoaming agent for breaking oil-in-water emulsions. The patent teaches the art of making highly branched polyDADMAC. These branched polyDADMAC are made by adding 0.1 to 3.0 mole % of crosslinking comonomer such as methyltriallyl ammonium chloride (MTAAC) or triallylamine hydrochloride (TAAHCl) during progressive polymerization of DADMAC after monomer conversion has achieved at least 25% to 90%.

A completely gelled product is obtained when the MTAA is added all at once in the beginning.

U.S. Pat. No. 4,100,079 discloses the use of copolymers of DADAMC and N-methylolacrylamide capable of post crosslinking as acid thickening agents in oil well drilling and fracturing for stimulating well production.

U.S. Pat. No. 4,225,445 discloses that branched DADMAC polymers are useful as acid thickeners in oil well drilling and fracturing operations. The branched DADMAC polymers are prepared by inverse emulsion polymerization of DADMAC with a crosslinker monomer such as triallylmethylammonium chloride.

U.S. Pat. No. 5,653,886 discloses the use of crosslinked DADMAC polymers as coagulants in suspensions of inorganic solids for mineral refuse slurry. The preferred high molecular weight crosslinked polyDADMAC for the application is prepared by copolymerization of DADMAC with acrylamide and triallylamine.

In studying interaction of cationic polyelectrolytes with counter anions, Ghimici et al (Journal of Polymer Science: Part B, Vol. 35, page 2571, 1997) found that the cationic polyelectrolyte sample with more branching or crosslinking had stronger binding with anionic counter ions. It is alleged that branching of the polycations creates regions with higher numbers of charged groups even at high dilution and consequently an increased number of counter ions is associated to them.

U.S. Pat. No. 5,989,382 uses a multifunctional (triallylamine) to make high molecular weight cross-linked polyDADMAC, which can be used for pitch control in papermaking.

Pitch and stickies are interfering substances in the wet end of papermaking which can affect both the machine runnability and paper quality. The term "pitch" used here refers to colloidal dispersion of wood-derived hydrophobic particles released from the fibers during pulping process and is also called wood pitch. Wood pitch includes fatty acids, resin acids, their insoluble salts, and esters of fatty acids with glycerol, sterols, and other fats and waxes. Pitch deposit problems are seasonal because pitch composition varies by season and type of wood. The hydrophobic components of pitch, particularly triglycerides, are considered the major factors determining whether the presence of such pitch will lead to deposit problem. Deposit-forming pitch always contains a significantly high amount of triglycerides. The term "stickies" used here refers to sticky materials and interfering substances which arise from components of recycled fibers, such as adhesives and coatings. Stickies can come from coated broke, recycled waste paper for board making and de-inked pulp (DIP). The stickies from coated broke are sometimes called white pitch. Deposition of pitch and stickies often lead to defects in finished product and paper machine downtime causing lost profit for the mill. These problems become more significant when paper mills "close up" their process water systems for conservation and environmental reasons. Unless the pitch and stickies are continuously removed from the system in a controlled manner, these interfering substances will accumulate and eventually lead to deposit and runnability problems.

Seasonal pitch and stickies from recycled coated papers and de-inked waste paper cause major runnability problems resulting in lost production and hence lost profit for the mill. Pitch from wood is seasonal. Stickies from coated broke, recycled waste paper for board making and de-inked fiber occurs when these furnishes are being used. Technology in place today is based on fixation of the pitch or stickies to the fiber before they have a chance to agglomerate, or to coat the pitch or stickies with a polymer that makes them non-tacky and therefore unable to agglomerate.

Three chemical methods are commonly used by paper mills to control pitch and stickies deposit:

1) detackification
2) stabilization
3) fixation

These methods are, however, not commonly used together since they may conflict with each other.

In detackification, a chemical is used to build a boundary layer of water around the pitch and stickies to decrease depositability. Detackification can be achieved by addition of pitch adsorbents such as talc and bentonite. However, pitch adsorbents such talc can end up contributing to pitch depositability if talc/pitch particles are not retained in the paper sheet surfactants, and water-soluble polymers.

In stabilization, surfactants and dispersants are used to chemically enhance colloidal stability and allow pitch and stickies to pass through the process without agglomerating or depositing. Cationic polymers are normally used as fixatives to control pitch and stickies through fixation. Nonionic polymers such as polyvinyl alcohol and copolymers such as polyacrylamide-vinyl acetate ( PCT Application WO 0188264) have been developed and used for stickies control through detackification. Hydrophobically modified anionic polymers such as a copolymer of styrene and maleic anhydride (U.S. Pat. No. 6,051,160) have been used for pitch deposit control through, most likely, the pitch stabilization mechanism.

In fixation, polymers are used to fix pitch and stickies to the fiber and remove them from the white water system. The interfering substances in papermaking systems are usually anionic in nature and are sometimes referred to as anionic trash or cationic demand. Anionic trash consists of colloidal (pitch and stickies) and dissolved materials that adversely affect the paper making in a variety of ways through deposit formation or interference with chemical additives. Removal of anionic trash by reducing cationic demand with a cationic polymer is a way of deposit control through fixation. The advantage of using cationic polymeric coagulants for pitch and stickies control is that the pitch and stickies are removed from the system in the form of microscopic particles dispersed among the fibers in the finished paper product.

U.S. Pat. No. 5,256,252 discloses a method for controlling pitch deposit using enzyme (lipase) with DADMAC polymers. A Filtrate turbidity test is used to evaluate performance for pitch control.

European Application No. 464993 discloses use of an amphoteric copolymer of DADMAC and acrylic acid salts for controlling natural pitch deposition. The polymers are not claimed for deposit control of stickies in recycle pulps and white pitch in coated broke. A filtrate turbidity test is one of the test methods used to evaluate the performance for pitch deposit control.

PCT Application No. WO 00034581 teaches that amphoteric terpolymers of DADMAC, acrylamide and acrylic acid can be used for treating coated broke to control white pitch. A filtrate turbidity test is used to determine performance of the polymers for white pitch deposit control.

European Application No. 058622 teaches a method for reducing or preventing the deposition of wood pitch during the papermaking process with an emulsion copolymer of DADMAC, DADEAC, acrylamide and acrylic acid. The DADMAC polymers used are not crosslinked.

U.S. Pat. No. 5,131,982 teaches use of DADMAC homopolymers and copolymers for coated broke treatment to control white pitch. The DADMAC polymers used are not crosslinked. The patent shows that crosslinked polyepiamines have better performance than a linear polyamine to give more turbidity reduction.

U.S. Pat. No. 5,837,100 teaches the use of blends of dispersion polymers and coagulants for coated broke treatment. Turbidity reduction testing is used to determine activity efficiency of the polymers.

U.S. Pat. No. 5,989,392 teaches the use of crosslinked DADMAC polymers for controlling anionic trash and pitch deposition in pulp containing broke. Pulp filtrate turbidity test is used to evaluate polymer performance in pitch deposition control. Improved efficiencies of solution crosslinked or branched polyDADMACs over conventional linear polyDADMAC are demonstrated. The crosslinked or branched polyDADMACs used are prepared using a polyolefinic crosslinking monomer such as triallylamine hydrochloride and methylene bisacrylamide.

European Application No. 600592 discloses a method to make low molecular weight crosslinked polyacrylate by post treatment with a radical initiator. The starting acrylate polymer solution is heated to a reaction temperature of 90° C. The desired amount of radical initiator is then added over a relatively short time period (15 to 30 minutes). The reaction temperature is maintained for an additional time, usually less than 2 hours, to use up the initiator added for crosslinking. The extent of crosslinking and MW increase is mainly controlled by reaction temperature, pH, the amount of initiator added, and the reaction time after the addition of the initiator. Initiator feed time is not used to control extent of crosslinking. The patent is related to making low MW crosslinked polyacrylates for dertergent and cleaning applications.

Crosslinking between the strong electrolyte polymeric radicals can be limited due to electrostatic repulsion. Ma and Zhu (Colloid Polym. Sci, 277:115-122 (1999) have demonstrated that polyDADMAC cannot undergo radical crosslinking by irradiation because the cationic charges repel each other. On the other hand, nonionic polyacrylamide can be readily crosslinked by irradiation. The difficulty of crosslinking polyDADMAC by organic peroxides was reported by Gu et al (Journal of Applied Polymer Science, Volume 74, page 1412, (1999). Treating polyDADAMC with a dialkylperoxide in melt (140 to 180° C.) only led to degradation of the polymer as being evident by a decrease in intrinsic viscosity.

SUMMARY OF THE INVENTION

A dual functional polymer capable of controlling deposition through both fixation and anionic trash reduction is desirable. The inventive water-soluble polymers described herein serve this dual purpose since they contain crosslinked structure and cationic functionality for fixation and charge neutralization.

Thus, the present invention relates to crosslinking water-soluble cationic polymers of diallyldimethylammonium chloride (DADMAC) which are strong cationic electrolyte polymers. Monomer DADMAC, in spite of containing two double bonds, undergoes cyclopolymerization to form a mostly linear, water-soluble polymer with repeating units of 5-membered pyrrolidinium heterocyclic rings. Polymers of DADMAC can be crosslinked by persulfate compounds only when residual monomer is reduced to sufficiently low levels that depend on the polymer concentration used for the post crosslinking.

There is a need for high molecular weight, crosslinked, water-soluble cationic polymers for pitch and stickies deposit control. One objective of this invention is to provide a crosslinked polymer of DADMAC with structure different from that of crosslinked polymers made by addition of a polyolefinic crosslinker as described in U.S. Pat. No. 5,989,392. While the crosslinked polymers made using a polyolefinic crosslinker have the crosslinker bridged between two connected polymer chains, the crosslinked polymers of the present invention do not contain crosslinker bridges and therefore are believed to have shorter crosslinking bridges with polymer chains simply connecting at some points on their backbones.

A desirable cationic polymer is one that can effectively and efficiently control both anionic trash and pitch and stickies deposit. The cationic polymers commercially used in paper mills for pitch and stickies control are homopolymers of DADMAC and polyepiamine prepared from epichlorohydrin and dimethylamine. It has now been discovered that water-soluble branched or crosslinked polymer of DADMAC prepared by post crosslinking with persulfate can be successfully used to control pitch and stickies deposit by removing them from the system in the form of microscopic particles.

The present invention is directed to application of a high molecular weight (MW), crosslinked, water-soluble cationic polymer for controlling and preventing deposition of pitch and stickies in papermaking. The method comprises the step of adding to paper furnish prior to sheet formation the high MW crosslinked or branched polyDADMAC to treat mechanical pulp for controlling wood pitch deposit, coated broke for controlling stickies or pitch deposit, and recycled pulp for controlling stickies deposit.

The high molecular weight (MW), crosslinked, water-soluble cationic polymer is-made by post crosslinking a cationic base polymer with a suitable radical initiator. The preferred cationic base polymers are those polymers made from polymerization of diallyldialkyl ammonium compounds which may be represented by the following formula:

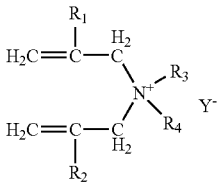

where $R_1$ and $R_2$ are hydrogen or a $C_1$-$C_4$ alkyl; $R_3$ and $R_4$ are, independently, hydrogen or an alkyl, hydroxyalkyl, carboxyalkyl, carboxyamide alkyl, alkoxyalkyl group having from 1 to 18 carbon atoms; and $Y^-$ represents an anion. The most preferred cationic monomer for the cationic base polymer is diallyldimethyl ammonium chloride (DADMAC).

Accordingly, the instant invention is directed to a method of controlling pitch and stickies deposition in papermaking, which method comprises the step of adding to paper furnish prior to sheet formation a multi-crosslinked cationic polymer, which polymer is prepared by the method comprising:

(i) polymerizing substantially all of the monomer components by free radical initiation to form a base cationic polymer solution, wherein at least one of the monomer components is a cationic monomer component; and (ii) contacting the base cationic polymer solution with additional free radical initiator to form interconnecting bonds between base cationic polymers to form said multi-crosslinked cationic polymer, wherein the multi-crosslinked cationic polymer has a higher molecular weight than the base cationic polymer.

The novel crosslinked polymer of DADMAC made and used in this invention has structure different from that of crosslinked polymers made by conventional method using a polyolefinic crosslinker. While the crosslinked polymers made using a polyolefinic crosslinker have the crosslinker bridged between two connected polymer chains, the crosslinked polymers of the present invention do not contain crosslinker bridges and therefore are believed to have shorter crosslinking bridges with polymer chains simply connecting at some points on their backbones.

DETAILED DESCRIPTION OF THE INVENTION

Cationic polymers are commonly used in papermaking to remove anionic trash by charge neutralization. Anionic trash consists of colloidal (pitch and stickies) and dissolved materials that adversely affect the paper making in a variety of ways through deposit formation or interference with chemical additives. Removal of anionic trash by fixing colloidal particles to fiber and reducing cationic demand with a cationic polymer is a way of pitch and stickies deposit control. The advantage of using cationic polymeric coagulants for pitch and stickies control is that the pitch and stickies are removed from the system in the form of microscopic particles dispersed among the fibers in the finished paper product. It has been discovered by the present inventors that the fixation of pitch and stickies to paper fiber and charge neutralization can be enhanced by the use of crosslinked or branched cationic polymers. The crosslinked or branched cationic polymers are formed by post crosslinking a cationic base polymer with a suitable radical initiator. The preferred cationic base polymers are those polymers made from polymerization of diallyldialkyl ammonium compounds represented by the following formula:

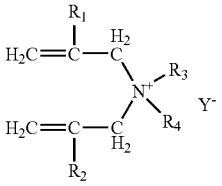

where $R_1$ and $R_2$ are hydrogen or a $C_1$-$C_4$ alkyl; $R_3$ and $R_4$ are, independently, hydrogen or an alkyl, hydroxyalkyl, carboxyalkyl, carboxyamide alkyl, alkoxyalkyl group having from 1 to 18 carbon atoms; and $Y^-$ represents an anion. The most preferred cationic monomer for the cationic base polymer is diallyldimethyl ammonium chloride (DADMAC).

Preferably, about 50 to about 100 percent by weight of the monomer, based on the weight of the total monomer components available for polymerization, is diallydimethylammonium chloride.

Cationic base polymers useful for crosslinking to prepare the high molecular weight crosslinked water-soluble cationic polymers of the present invention can be any commercially available water-soluble cationic polymers, especially homopolymers or copolymers of diallyldialkylammonium halide. Examples of commercially available homopolymers or copolymers of diallyldialkylammonium halide are those sold under the trade names of Agefloc® and Agequat ® by Ciba Specialty Chemicals.

Suitable cationic base polymers can also be copolymers of cationic monomers and other copolymerizable monomers. Examples of suitable monomers copolymerizable with cationic monomers include, but are not limited to, acrylamide, methacrylamide, N,N-dimethyl acrylamide, acrylic acid, methacrylic acid, vinylsulfonic acid, vinylpyrrolidone, hydroxyethyl acrylate, styrene, methyl methacrylate, vinyl acetate and mixtures thereof. Sulfur dioxide can also be used to copolymerize with DADMAC.

Polymerization of the cationic monomer for the cationic base polymer can be carried out by aqueous solution polymerization, water-in-oil inverse emulsion polymerization or dispersion polymerization using a suitable free radical initiator. Examples of suitable free radical initiators for forming the base cationic polymer in step (i) of the invention include persulfates such as ammonium persulfate (APS); peroxides such as hydrogen peroxide, t-butyl hydroperoxide, and t-butyl peroxy pivalate, azo initiators such as 2,2'-azobis(2-amidinopropane) dihydrochloride, 4,4'-azobis-4-cyanovaleric acid and 2,2'-azobisisobutyronitrile; and redox initiator systems such as t-butyl hydroperoxide/Fe(II) and ammonium persulfate/bisulfite. Aqueous solution polymerization using ammonium persulfate (APS) is the preferred method for preparing the base cationic polymer of the preferred monomer DADMAC. The amount of the free effective radical initiator used in the polymerization process depends on total monomer concentration and the type of monomers used and may range from about 0.2 to about 5.0 wt % of total monomer charge to achieve more than 99% of total monomer conversion.

It is preferred to carry out the polymerization in the absence of oxygen. Oxygen can be removed from the reaction medium by applying vacuum with agitation or by purging with an inert gas such as nitrogen and argon. The polymerization can then be conducted under a blanket of the inert gas.

Diallylamine monomers such as DADMAC, although containing two unsaturated C=C double bonds, are well known to form linear polymers with a free radical initiator through cyclopolymerization. The linear polymers thus formed contain repeating units of 5-membered pyrrolidinium rings. It is desirable to make linear base polymer with as high a molecular weight as the free radical polymerization process can provide if a high molecular weight lightly crosslinked final product is desired. Reaction conditions such as monomer concentration, initiator concentration, reaction temperature and reaction time all combine to affect the rate of radical polymerization and molecular weight of the obtained base polymer. Those skilled in the art, being aware of the principles of the present invention as disclosed herein, will be capable of selecting suitable reaction conditions to achieve high molecular weight. The post-crosslinking technology disclosed in the present invention can then be used to raise the molecular weight to an even higher value.

The multi-crosslinked cationic polymer of the invention has a weight average molecular weight greater than about 600,000 g/mole. Preferably, the weight average molecular weight is greater than 700,000 g/mole and most preferably greater than about 850,000 g/mole.

Brookfield viscosity is a function of molecular weight, concentration and temperature. Therefore viscosity is related to molecular weight at a fixed concentration and temperature. For example a viscosity of 2500 cps at 20% polymer for Alcofix® 111 at 25° C. corresponds to a weight average molecular weight of approximately 600,000 measure by GPC using poly(ethylene oxide) narrow molecular weight standards. The higher the viscosity, the higher the molecular weight. For the purposes of the invention, the multi-crosslinked cationic polymer of the invention has a viscosity of above 2000 cps at 20% concentration in water at 25° C. Preferably, the viscosity is about 2500 to about 25,000 cps at 20% concentration in water at 25° C.

For example, a preferred multi-crosslinked cationic polymer has a Brookfield viscosity when measured at 25° C. and 20% solids concentration in water using a number 3 spindle at 12 revolutions per minute of about 2000 to about 10,000 cps, wherein the solids concentration is based on the total weight of the solution.

Another preferred multi-crosslinked cationic polymer solution of the invention has a Brookfield viscosity when measured at 25° C. and 20% solids concentration in water using a number 4 spindle at 12 revolutions per minute of about 10,000 to about 20,000 cps, wherein the solids concentration is based on the total weight of the solution.

The cationic base polymer is chain extended or crosslinked by treating it with additional suitable radical initiator of step (ii) in aqueous solution under agitation. Additional suitable radical initiator in step (ii) for the purposes of the invention is a compound that can create radical sites on the cationic base polymer and help to overcome the positive electrostatic repulsion for combination of the cationic base polymeric radicals. Examples of suitable radical initiators are persulfate compounds such as potassium persulfate, sodium persulfate, ammonium persulfate, and the like. Other additional suitable radical initiators of step (ii) may include salts or derivatives of percarbonic acid (such as isopropyl percarbonate) and salts or derivatives of perphosphonic acid. The above mentioned radical initiators may be used alone or in combination with various reducing agents to form redox initiator systems. Other polymerization initiators not mentioned above but known to people skilled in the art may also be used for the crosslinking reaction under suitable reaction conditions. The most preferred radical initiators for crosslinking the cationic base polymers are ammonium persulfate, sodium persulfate and potassium persulfate in view of the crosslinking efficiency, water solubility and the decomposition temperature.

The additional radical initiator of step (ii) is used in an amount ranging from about 0.02 to about 50%, preferably from about 0.5 to 10% and even more preferably from about 1 to 5% by weight based on the cationic base polymer. The chain-extending or crosslinking reaction can be carried out in aqueous medium or in the same reaction medium (e.g., water-in-oil emulsion) as used for preparing the base polymer. The crosslinking reaction can be carried out in aqueous medium at a pH from about 1 to about 12, preferably from 4 to 7, and at a temperature from about 20 to about 100° C., preferably from 70 to 100° C. without using reducing agents.

The solids concentration of base polymer in the reaction medium prior to reaction can be, by weight, from 1% to about 70%, preferably from 10% to 40% for a solution base polymer, and preferably from 20 to 50% for an emulsion or dispersion base polymer. All percent weights are based on the total medium, solution, emulsion or dispersion. Most preferably the base cationic polymer solution is diluted to a solids content of less than 30 percent by weight prior to the start of step (ii).

The required additional initiator of step (ii) may be added all together in the reactor at reaction temperature to crosslink the base polymer. However, addition of large amount of the initiator may cause undesirable formation of water-insoluble gels. The additional free radical initiator of step (ii) is added in incremental amounts over a defined period of time. For better control of molecular weight or viscosity advancement, the initiator can be added in small increments or at a modest continuous rate. The reaction is allowed to proceed after each incremental addition (note: the increments can be made sufficiently small to be nearly a continuous addition) of the initiator until the increase in the viscosity begins to level off. If the desired product viscosity has not yet been reached, another increment of initiator will be added. When the desired product viscosity is achieved, cooling to room temperature stops the reaction.

The preferred way to control the crosslinking reaction is by continuously feeding the additional initiator at a rate such that viscosity advancement of the reaction medium can be easily monitored. The efficiency of the initiator for crosslinking increases with decreasing feed rate of the initiator. Slow additional initiator feed rate gives high efficiency of the initiator for crosslinking and also provides easy control of viscosity or molecular weight advancement. The crosslinking reaction can be terminated once a desired viscosity or molecular weight is achieved by stopping the additional initiator feed and cooling the reaction. The effect of the initiator after stopping the initiator feed is small if a slow initiator feed rate is used. The additional initiator of step (ii) can be fed to the aqueous solution of the base polymer at a rate from 10% to 0.0005%, preferably from 0.2% to 0.001%, and the most preferably from 0.05% to 0.002 % per minute by weight based on polymer solids.

The exact mechanism of the crosslinking reaction is not specifically known. However, it is likely that free radicals are involved. In the case of using persulfate initiator, the crosslinking mechanism may be illustrated by the following scheme.

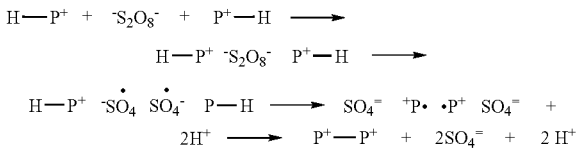

The persulfate di-anion brings two cationic base polymer (H—P$^+$) together through ionic bonding. The homolytic decomposition of persulfate produces two anionic sulfate radicals that abstract hydrogen atoms from the base polymer chains to create two polymer radicals. Crosslinking is effected only when two polymer radicals combine. The polymer radicals formed, if not finding each other for crosslinking, may undergo degradation through chain transfer or disproportionational termination. The persulfate dianions help to bring together for crosslinking two cationic polymer radicals, which otherwise have difficulty meeting each other because of the cationic electronic repulsion. Thus, persulfate initiators have a high efficiency for crosslinking cationic polymers. Other initiators such as hydrogen peroxide can create cationic polymer radicals, which, however, because of the difficulty of overcoming electron repulsion forces for crosslinking, tend to undergo degradation through chain transfer, or termination. Moreover, radical initiators such as hydrogen peroxide may have a much higher tendency than persulfate to induce chain transfer degradation. Residual double bonds on the cationic base polymer may also play a role in crosslinking. The present inventors do not intend to be limited to any crosslinking mechanism proposed.

In the above-proposed crosslinking scheme, every persulfate molecule abstracts 2 hydrogen atoms to create two polymer radicals for crosslinking. The two abstracted hydrogen atoms are oxidized to two protons. Thus, the reaction pH will drift down if no base is added to neutralize them. The decrease in pH is indeed observed with addition of persulfate initiator during the crosslinking reaction. The above-proposed mechanism is also supported by the experimental fact that a feed molar ratio of NaOH and ammonium persulfate of around 2.0 is optimal to achieve high crosslinking efficiency and keep reaction pH relatively constant.

In order to keep the crosslinking reaction at a desired pH during the course of the additional initiator feed, a base may be added to keep the pH from drifting downward. Examples of suitable bases that can be used alone or in combination for pH control include NaOH, KOH, $NH_4OH$, $Na_2CO_3$, and the like. The preferred base for the pH control is NaOH. The base can be added by continuous feeding with the initiator feed at a fixed ratio. The feed ratio of the base to the persulfate by moles can be from 0 to 8, preferably from 1 to 3, and the most preferably from 1.5 to 2.5. The base can also be added whenever the pH drops to below the desired value. As previously indicated, the crosslinking reaction can be carried out in aqueous medium at a pH of from about 1 to about 12. However it is preferably carried out in aqueous medium at a pH of from about 4 to 7.

The pH of the crosslinking reaction can also be controlled by using a pH controller. A base such as NaOH can be added to the reactor automatically through the pH controller whenever the reaction pH drifts down to a desired value.

Polymers of DADMAC can be crosslinked by persulfate compounds only when residual DADMAC monomer is reduced to sufficiently low levels. The maximum residual monomer level at which the crosslinking can occur depends on the polymer concentration used for the crosslinking reaction. Therefore, it is desirable that the cationic base polymer is substantially polymerized and contains less than 10% residual monomer, preferably less than 3%, and most preferably less than 1% by weight of the base polymer solids. However, base polymers containing more than the desired amount of residual monomers can still be crosslinked by the methods disclosed in the present invention. In such cases, the radical initiator added in the crosslinking reaction is initially used for reduction of residual monomer. Once the residual monomer is reduced to sufficiently low levels, the base polymer will begin crosslinking with the continuation of initiator addition.

The chain-extension or crosslinking reaction is preferably carried out under agitation. Adequate agitation can prevent formation of gel particles. Suitable agitation should not cause enough shear to result in significant polymer chain scission.

The specific embodiments of this invention are illustrated by the following examples. These examples are illustrative of this invention and not intended to be limiting.

The symbols below are used in the following examples:

APS=ammonium persulfate

BV=Brookfield viscosity, cps

DAA=diallylamine

FAU=formazine attenuation units

GPC=gel permeation chromatography

HC=Huggins constant

IV=intrinsic viscosity (measured in 1M NaCl solution), dL/g at 30° C.

Mw=weight average molecular weight (by GPC using PEO standard), g/mole

Mn=number average molecular weight (by GPC using PEO standard), g/mole

NTU=Nephelometric turbidity units

NaPS=sodium persulfate

PS=polymer solids, wt %

RM=residual monomer (of DADMAC), wt %

MBS=sodium metabisufite

CCD=cationic charge demand, meq/L;

TR=turbidity reduction;

EXAMPLES

Preperation of High MW Crosslinked PolyDADMAC

TABLE 1

Properties of APS crosslinked polyDADMAC polymers prepared in Examples 1 and 2

| Polymer # | Example # | APS used for crosslink wt % solids | Polymer Solids | Brookfield Viscosity, cps | Theoretical charge density, meq/g |
|---|---|---|---|---|---|
| 1 | 1 | 1.3 | 20% | 3400 | 6.2 |
| 2 | 1 | 1.7 | 20% | 4500 | 6.2 |
| 3 | 2 | 0.4 | 20% | 3150 | 6.2 |
| 4 | 2 | 1.4 | 20% | 4880 | 6.2 |
| 5 | 2 | 1.6 | 20% | 6420 | 6.2 |
| 6 | 2 | 1.7 | 20% | 6800 | 6.2 |

Example 1

An Alcofix® 111 aqueous solution polyDADMAC, commercially available from the Ciba Speciality Chemicals, is used as the cationic base polymer for chain extension or cross-linking in this example. Brookfield viscosity is measure using a #3 spindle at 12 RPM and at 25° C.

A 1-liter reactor fitted with a mechanical agitator, addition funnel and condenser is charged with Alcofix® 111 to contain 198.5 grams net DADMAC homopolymer. Polymer concentration is adjusted to 30% with deionized water. The reactor content is adjusted with NaOH solution to a pH of 6.9 and then heated to 100° C. with agitation and nitrogen purge. At 100° C., 25.0 g of 10% APS solution is fed to the reactor over 170 minutes to prepare Polymer 1, and additional 8.7 g of 10% APS is fed over 90 minutes to prepare Polymer 2. During the APS feeds, a 25% NaOH solution is co-fed to the reactor at a rate to give a NaOH/APS feed molar ratio of 2.0. Total APS used is 1.3% based on polymer solids for polymer 1 and 1.7% for Polymer 2. After the APS/NaOH co-feeds, the reactor content is held at 100° C. for 10 minutes and then cooled down to room temperature. The reactor content is adjusted with deionized water to give 20% polymer solids. A product free from water-insoluble gel is obtained with the properties shown in Table 1. The BV at 20% solids increases about 1.4 times for Polymer 1 and 1.8 times for Polymer 2 after the chain extension reaction.

Example 2

A 1-liter reactor equipped with a condenser, a thermometer, a nitrogen inlet, and an overhead agitator is charged with 500.38 g of 66% monomer DADMAC, 55.5 g of deionized water and 0.15 g of Versene ($Na_4EDTA$). The polymerization mixture is purged with nitrogen and heated with agitation to a temperature of 70° C. An aqueous solution containing 3.0 g of ammonium persulfate (APS) is slowly fed to the reactor over 435 minutes. The reaction temperature was allowed to increase to above 80° C. and then maintained at 80 to 90° C. during the APS feed period. After the APS feed, the reaction mixture is diluted with deionized water to about 40% solids and held at 90° C. for about 30 minutes. Then an aqueous solution containing 4.0 g of MBS is added over 25 minutes. The reactor is held at 90° C. for another 30 minutes to complete the polymerization (above 99% conversion). The polymer solution is diluted with sufficient water to about 25% solids. This product has a viscosity of about 2500 cps at 20% solids at 25° C. and is used as the cationic base polymer for chain extension to prepare Polymers 3 to 6 by the procedure shown below. A viscosity of 2500 corresponds to a molecular weight of approximately 600,000.

754 g of the above reactor content is heated to 100° C. Then, 12.0 g of a 10% APS solution is fed to the reactor over 60 minutes to prepare Polymer 3; 41.9 g of a 10% APS solution is fed to the reactor over 300 minutes to prepare Polymer 4; 47.9 g of a 10% APS solution is fed to the reactor over 345 minutes to prepare Polymer 5; 60.0 g of a 10% APS solution is feed to the reactor over 365 minutes to prepare Polymer 6; During the APS feeding, a 25% NaOH solution is added to maintain the reaction pH at about 5. The reactor content is held at 100° C. with agitation for about 10 minutes. Deionized water is then added to dilute the polymer solids to 20.0% and the reactor content is cooled down to room temperature. A gel-free clear polymer solution product is obtained with the properties shown in Table 1.

Performance Evaluation

Commercial products listed in Table 2 were also used in the evaluation for comparison.

TABLE 2

Commercial products used for comparison

| Commercial products | Polymer type | [3]Polymer Solids | [2]Brookfield Viscosity, cps | Theoretical charge density, meq/g |
|---|---|---|---|---|
| [1]Alcofix 169 | DADMAC homopolymer | 40% | 2000 | 6.2 |
| Alcofix 269 | DADMAC homopolymer | 40% | 3000 | 6.2 |
| Alcofix 110 | DADMAC homopolymer | 20% | 1500 | 6.2 |
| Alcofix 111 | DADMAC homopolymer | 20% | 2500 | 6.2 |
| Alcofix 131 | DADMAC homopolymer | 100% | beads | 6.2 |
| Alcofix 132 | DADMAC homopolymer | 100% | beads | 6.2 |
| WT3300 | DADMAC/ acrylamide copolymer | 35% | 11,400 | |
| Alcofix 159 | polyepiamine | 50% | 750 | 7.2 |
| Alcofix 160 | polyepiamine | 50% | 6000 | 7.2 |

*Alcofix ® is a tradename of Ciba Specialty Chemical Corporation.
[2]Brookfield viscosity is measured at spindle # 3 at 12 RPM and at 25° C. and at a 20% solids concentration. Above 10,000 cps, the Brookfield viscosity uses spindle # 4 at 30 or 12 RPM.
[3]% solids is based on the total weight of the solution.

Pitch and stickies deposit control performance of the crosslinked polyDADMAC A vacuum drainage filtrate turbidity test is used to demonstrate the performance of the polymer and its ability to fix pitch, stickies and other contaminants onto fibre and therefore control and prevent these contaminants from deposition during paper making. The detailed test procedure is shown below.

1. About 250 mL of a 3-5% consistency furnish is measured into a baffled Britt jar. Adequate mixing is provided with an IKA mixer set to agitate at 1000 rpm.
2. The required amount of polymer is added to the agitated thick stock and allowed to mix for 2 minutes.
3. The treated thick stock is then filtered through a Whatman 541 filter paper (11 cm diameter, coarse—retention for particles>20-25 microns) under vacuum.
4. Vacuum filtration continues until the "wet line" just disappears or approximately 200 mLs of filtrate is collected.
5. Turbidity of the filtrate is measured with a suitable turbidimeter.

6. Cationic charge demand (CCD) of the filtrate is determined by colloidal titration.

Dosage used is weight in pounds of active polymer per ton of pulp solids.

The lower the filtrate turbidity, the greater is the pitch and stickies control of the treatment employed and therefore the better performance of the polymer used.

Example 3

Wood Pitch Control for Thermo-Mechanical Pulp (TMP)

Example 3A

| TMP 3.5% consistency | | | blank Turbidity, 837 NTU | | |
|---|---|---|---|---|---|
| Dosage, lb/ton | 0.4 | 0.8 | 1.2 | 1.6 | 2.0 |
| | Turbidity, NTU | | | | |
| Alcofix 111 | 463 | 238 | 158 | 112 | 78 |
| Polymer 1 | 455 | 228 | 133 | 78 | 56 |
| Polymer 2 | 456 | 222 | 142 | 98 | 62 |

Example 3B

TMP 3.15% Consistency (Blank=785 NTU)

| | Sample | | | | | | | |
|---|---|---|---|---|---|---|---|---|
| | WT3300 | Alcofix 111 | Polymer 1 | Polymer 2 | Polymer 3 | Polymer 4 | Polymer 5 | Polymer 6 |
| | 20% Viscosity, cps | | | | | | | |
| Dosage lb/Ton | 500 | 2500 | 3400 | 4500 | 3150 | 4880 | 6420 | 7620 |
| | Filtrate turbidity, NTU | | | | | | | |
| 0.4 | 668 | 628 | 699 | 712 | 607 | 600 | 646 | 559 |
| 0.8 | 488 | 449 | 361 | 356 | 475 | 435 | 336 | 359 |
| 1.2 | 296 | 240 | 244 | 240 | 230 | 182 | 186 | 219 |
| 1.6 | 188 | 210 | 141 | 151 | 137 | 169 | 129 | 153 |
| 2 | 171 | 143 | 181 | 137 | 80 | 112 | 108 | 120 |
| Average NTU | 362.2 | 334 | 325.2 | 319.2 | 305.8 | 299.6 | 281 | 282 |
| Improve over Alcofix 111, % | −8% | 0% | 3% | 4% | 8% | 10% | 16% | 16% |

Example 4

Stickies Control for Recycled Deinked Pulps (DIP)

Filtrate turbidity (FT) and filtrate cationic charge demand (CCD) is measured to evaluate performance of the polymers. Lower FT and CCD indicate better performance for stickies deposit control.

Example 4A

This work is undertaken using recylcled newsprint thick-stock collected after the second press.

CCD=cationic charge demand, meq/L; FT=filtrate turbidity;

| | | dosage, kg/ton | | | | |
|---|---|---|---|---|---|---|
| Product | | 1 | 2 | 5 | 10 | Average |
| Alcofix 160 | turbidity, NTU | 229 | 108 | 50 | 31 | 104.50 |
| | CCD, meq/L | 9.72 | 8.60 | 3.97 | | 7.43 |
| Alcofix 111 | turbidity | 236 | 79 | 42 | 23 | 95.00 |
| | CCD, meq/L | 10.13 | 8.01 | 4.10 | | 7.41 |
| Polymer 2 | turbidity | 204 | 64 | 37 | 30 | 83.75 |
| | CCD, meq/L | 9.61 | 8.10 | 3.70 | | 7.14 |

Example 4B

Fixatives Evaluation on Recycled Deinked Pulp

| | Dosage, kg/t | | | | | |
|---|---|---|---|---|---|---|
| | 0 | 0.1 | 0.2 | 0.4 | 0.8 | |
| Product | filtrate turbidity, NTU | | | | | Average NTU* |
| Alcofix 159 | 761 | 184 | 135 | 73 | 47 | 110 |
| Alcofix 160 | 761 | 193 | 136 | 70 | 46 | 111 |
| Alcofix 169 | 761 | 221 | 190 | 143 | 63 | 154 |
| Alcofix 110 | 761 | 230 | 198 | 79 | 55 | 141 |

-continued

| | Dosage, kg/t | | | | | |
|---|---|---|---|---|---|---|
| | 0 | 0.1 | 0.2 | 0.4 | 0.8 | |
| Product | filtrate turbidity, NTU | | | | | Average NTU* |
| WT3300 | 761 | 209 | 147 | 79 | 55 | 123 |
| Alcofix 111 | 761 | 193 | 111 | 68 | 43 | 104 |
| Alcofix 132 | 761 | 221 | 185 | 84 | 28 | 130 |
| Alcofix 131 | 761 | 221 | 180 | 45 | 39 | 121 |
| Polymer 2 | 761 | 184 | 104 | 76 | 47 | 103 |

*excluding NTU for blank (0 dosage)

Example 4C

Performance Evaluation Of Crosslinked PolyDADMAC on DIP 3.5% Furnish

Filtrate Turbidity FAU At Different Dosages of DADMAC Polymer

| Product | Dosage, kg/ton | | | |
|---|---|---|---|---|
| | 2 | 4 | 6 | 8 |
| | Filtrate turbidity, FAU | | | |
| WT 3300 | 139 | 68 | 47 | 44 |
| Alcofix 111 | 95 | 65 | 45 | 41 |
| Polymer 2 | 128 | 57 | 47 | 40 |
| Polymer 3 | 148 | 54 | 47 | 41 |
| Polymer 4 | 159 | 65 | 49 | 43 |
| Polymer 5 | 157 | 73 | 48 | 41 |
| Polymer 6 | 115 | 68 | 39 | 34 |

Example 4D

Filtrate Cationic Charge Demand (CCD) at Different Dosages of DADMAC Polymer

| Product | dosage, kg/ton | | |
|---|---|---|---|
| | 2 | 4 | 6 |
| | CCD, meq/L | | |
| WT 3300 | 10.133 | 3.889 | 1.011 |
| Alcofix 111 | 9.697 | 3.567 | 0.997 |
| Polymer 2 | 10.367 | 4.019 | 1.100 |
| Polymer 3 | 10.679 | 4.196 | 1.123 |
| Polymer 4 | 10.75 | 4.306 | 1.136 |
| Polymer 5 | 10.488 | 4.093 | 0.967 |
| Polymer 6 | 10.106 | 3.894 | 0.956 |

Example 5

White Pitch Control for Recycled Coated Broke

Performance of the DADMAC polymers for white pitch control are evaluated on different types of coated broke. The samples are tested following three types of broke 45# Pub Matte, a light-weight free sheet;

38# DPO, heavy weight groundwood containing.

70 # DPO, heavy weight groundwood containing.

For each dosage of polymer treatment, the turbidity of the filtrate is measured.

Example 5A

45# Pub Matte, a Light-Weight Free Sheet

| Product | Dosage lb/ton | | | | | | | | | | |
|---|---|---|---|---|---|---|---|---|---|---|---|
| | 0 | 0.4 | 0.8 | 1.0 | 1.2 | 1.6 | 2.0 | 2.4 | 3.0 | 3.2 | 4.0 |
| | Filtrate Turbidity, FAU | | | | | | | | | | |
| Polymer 6 | 5794 | 3063 | 495 | | 179 | 118 | | | | | |
| Alcofix 110 | 5794 | 2995 | 825 | | 246 | 200 | | | | | |
| Alcofix 269 | 5794 | | 2011 | | | 322 | | 248 | | 257 | |
| Alcofix 159 | 5794 | | | 1258 | | | 447 | | 316 | | 169 |

Example 5B

70 # DPO, Heavy Weight Groundwood Containing

| Product | Dosage lb/ton | | | | | | | | | | |
|---|---|---|---|---|---|---|---|---|---|---|---|
| | 0 | 0.4 | 0.8 | 1.0 | 1.2 | 1.6 | 2.0 | 2.4 | 3.0 | 3.2 | 4.0 |
| | Filtrate Turbidity, FAU | | | | | | | | | | |
| Polymer 6 | 659 | 216 | 54 | | 41 | 37 | | | | | |
| Alcofix 110 | 659 | 170 | 87 | | 58 | 46 | | | | | |
| Alcofix 269 | 659 | | 157 | | | 130 | | 97 | | 108 | |
| Alcofix 159 | 659 | | | 110 | | | 87 | | 72 | | 57 |

Example 5C

38# DPO, Heavy Weight Groundwood Containing

| | Dosage lb/ton | | | | | | | | | | |
|---|---|---|---|---|---|---|---|---|---|---|---|
| | 0 | 0.4 | 0.8 | 1.0 | 1.2 | 1.6 | 2.0 | 2.4 | 3.0 | 3.2 | 4.0 |
| Product | Filtrate Turbidity, FAU | | | | | | | | | | |
| Polymer 6 | 11432 | 10440 | 5108 | | 1792 | 342 | | | | | |
| Alcofix 110 | 11432 | 11368 | 5192 | | 2172 | 184 | | | | | |
| Alcofix 269 | 11432 | | 2512 | | | 247 | | 127 | | 209 | |
| Alcofix 159 | 11432 | | | 6856 | | | 2286 | | 319 | | 123 |

It should be understood that the above description and examples are illustrative of the invention, and are not intended to be limiting. Many variations and modifications are possible without departing from the scope of this invention.

What is claimed is:

1. A method of controlling pitch and stickies deposition in papermaking, which method comprises the step of adding to paper furnish prior to sheet formation a multi-crosslinked cationic polymer, which polymer is prepared by the method comprising:

(i) polymerizing substantially all of the monomer components by free radical initiation to form a base cationic polymer solution, wherein at least one of the monomer components is a cationic monomer component; and (ii) contacting the base cationic polymer solution with additional free radical initiator to form interconnecting bonds between the base cationic polymers to form the multi-crosslinked cationic polymer and the interconnecting bonds occur at points on the backbone of the cationic polymer, wherein the multi-crosslinked cationic polymer has a higher molecular weight than the base cationic polymer, which base cationic polymer is a homopolymer formed from diallydialkylammonium monomer.

2. A method according to claim 1 wherein the additional free radical initiator used in step (ii) is selected from the group consisting of potassium persulfate, sodium persulfate, ammonium persulfate, salts of percarbonic acid, salts of perphosphonic acid and mixtures thereof.

3. A method according to claim 1 wherein the additional free radical initiator used in step (ii) consists of an effective amount of ammonium persulfate.

4. A method according to claim 1 wherein the additional free radical initiator is added in incremental amounts over a defined period of time.

5. A method according to claim 1 wherein the base cationic polymer solution is diluted to a solids content of less than 30% by weight based on the total solution prior to start of step (ii).

6. A method according to claim 4 wherein the base cationic polymer solution is diluted to a solids content of less than 30% by weight based on the total solution prior to start of step (ii).

7. A method according to claim 1 wherein the multi-crosslinked cationic polymer formed in step (ii) has a weight average molecular weight greater than 700,000 g/mole.

8. A method according to claim 7 wherein the multi-crosslinked cationic polymer formed in step (ii) has a weight average molecular weight greater than 850,000 g/mole.

9. A method according to claim 1 wherein the multi-crosslinked cationic polymer formed in step (ii) has a Brookfield viscosity when measured at 25° C. and 20% solids concentration in water of above 2000 cps using a number 3 or 4 spindle at 12 revolutions per minute, wherein the solids concentration is based on the total weight of the solution.

10. A method according to claim 9 wherein the multi-crosslinked cationic polymer formed in step (ii) has a Brookfield viscosity when measured at 25° C. and 20% solids concentration in water of about 2000 to about 10,000 cps using a number 3 spindle , wherein the solids concentration is based on the total weight of the solution.

11. A method according to claim 9 wherein the multi-crosslinked cationic polymer has a Brookfield viscosity when measured at 25° C. and 20% solids concentration in water of about 10,000 to about 20,000 cps using a number 4 spindle, wherein the solids concentration is based on the total weight of the solution.

12. A method according to claim 1 wherein the diallyldialkyl ammonium monomer is represented by the formula:

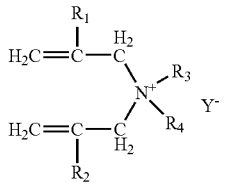

where $R_1$ and $R_2$ are independently of one another hydrogen or $C_1$-$C_4$ alkyl; $R_3$ and $R_4$ are, independently of one another, hydrogen or an alkyl, hydroxyalkyl, carboxyalkyl, carboxyamidoalkyl, alkoxyalkyl group having from 1 to 18 carbon atoms; and $Y^-$ represents an anion.

13. A method according to claim 12 wherein the diallydialkylammonium monomer is selected from the group consisting of diallyldimethylammonium chloride, diallyldimethylammonium bromide, diallyldimethylammonium sulfate, diallyldimethylammonium phosphate, dimethallyldimethylammonium chloride, diethylallyldimethylammonium chloride, diallyldi(beta-hydroxyethyl) ammonium chloride, diallyldi(beta-ethoxyethyl) ammonium chloride, diallyldiethylammonium chloride and mixtures thereof.

14. A method according to claim 13 wherein at least 50% by weight of the monomer, based on the weight of the entire monomer component or components available for polymerization, is diallyldimethylammonium chloride.

15. The method of claim 1 wherein the paper furnish contains thermal mechanical pulp.

16. The method of claim 1 wherein the paper furnish contains recycled pulp.

17. The method of claim 1 wherein the paper furnish contains coated broke.

18. The method of claim 1 wherein the paper furnish contains deinked pulp.

19. The method of claim 1 wherein the paper furnish contains a mixture of at least two selected from the group consisting of thermal mechanical pulp, recycled pulp, deinked pulp and coated broke.

20. A method according to claim 1, wherein (ii) is run in the presence of base.

21. A method according to claim 1, wherein the amount of additional free radical initiator in (ii) is from about 0.5 to 10% by weight based on the cationic base polymer.

22. A method according to claim 1, wherein the base cationic polymer solution contains less than 1% residual monomer based on the weight of the base polymer.

23. A method according to claim 22, wherein the concentration of the base polymer prior to reaction is from 1 to about 70 percent weight of the solution in (ii).

* * * * *